US008714397B2

(12) United States Patent
Bravo et al.

(10) Patent No.: US 8,714,397 B2
(45) Date of Patent: May 6, 2014

(54) ELECTRICAL OFFSET

(75) Inventors: Sergio M. Bravo, Commerce, CA (US); Don K. Mukai, Pasadena, CA (US)

(73) Assignee: S. Bravo Systems, Inc., Commerce, CA (US)

( * ) Notice: Subject to any disclaimer, the term of this patent is extended or adjusted under 35 U.S.C. 154(b) by 1064 days.

(21) Appl. No.: 12/390,371

(22) Filed: Feb. 20, 2009

(65) Prior Publication Data

US 2009/0212057 A1 Aug. 27, 2009

Related U.S. Application Data

(60) Provisional application No. 61/030,193, filed on Feb. 20, 2008.

(51) Int. Cl.
*B65D 88/10* (2006.01)

(52) U.S. Cl.
USPC ..... 220/571; 220/567.1

(58) Field of Classification Search
CPC ..... B65D 88/76; B65D 90/24; B65D 90/20; B65D 88/022; B65D 88/10; G01F 15/14; B67D 7/3209; E02D 29/12
USPC ..... 220/571, 567.1, 567.2, 694, 484, 565; 141/86; 52/20; 405/52; 404/25
See application file for complete search history.

(56) References Cited

U.S. PATENT DOCUMENTS

| | | | | |
|---|---|---|---|---|
| 3,952,531 | A * | 4/1976 | Turner | 62/45.1 |
| 4,527,708 | A * | 7/1985 | Dundas et al. | 220/484 |
| 4,655,361 | A * | 4/1987 | Clover et al. | 137/363 |
| 4,989,634 | A * | 2/1991 | Rieseck | 137/363 |
| 5,007,557 | A * | 4/1991 | Spence | 220/571 |
| 5,056,680 | A * | 10/1991 | Sharp | 220/567.1 |
| 5,238,033 | A * | 8/1993 | Bald | 141/86 |
| 5,800,143 | A * | 9/1998 | Bravo | 405/52 |
| 5,813,797 | A * | 9/1998 | Pendleton | 405/52 |
| 6,182,679 | B1 * | 2/2001 | Pendleton | 137/68.14 |
| 6,266,928 | B1 * | 7/2001 | Argandona | 52/20 |
| 7,150,582 | B2 * | 12/2006 | Burwell | 405/52 |
| 2001/0022302 | A1 * | 9/2001 | Dunn et al. | 220/62.11 |

* cited by examiner

*Primary Examiner* — Steven A. Reynolds
(74) *Attorney, Agent, or Firm* — Christie, Parker & Hale, LLP

(57) ABSTRACT

A frame assembly for anchoring a containment box with a top opening in a surrounding driveway surface and for removably attaching one of a plurality of different product dispensers to the containment box. The frame assembly includes an anchor frame attached to the top opening of the containment box wherein the anchor frame is configured to be removably attached to any one of a plurality of different dispenser frames and a dispenser frame removably attached to the anchor frame, the dispenser frame including a plurality of frame walls having a frame area larger than an area of the top opening of the containment box such that the frame walls define an offset opening adjacent to the top opening of the containment box, wherein the dispenser frame is adapted to be mounted to one of the plurality of different product dispensers.

14 Claims, 8 Drawing Sheets

ELECTRICAL OFFSET

CROSS-REFERENCE TO RELATED APPLICATION(S)

This application claims priority to and the benefit of U.S. Provisional Patent Application 61/030,193, filed on Feb. 20, 2008, the entire content of which is incorporated herein by reference.

FIELD OF THE INVENTION

The present invention relates to a frame assembly for anchoring a containment box of the type used for the secondary containment of fluid spills at a gasoline service station.

BACKGROUND OF THE INVENTION

Gasoline service stations typically include a number of islands upon which product dispensers are mounted. Beneath each product dispenser is a containment box penetrated by a product supply line which feeds product to the dispenser. The containment box is intended to contain any leakage of product from the dispenser in the event of a failure of the piping or other equipment located within the dispenser.

The top of a containment box typically has a dispenser frame that includes an outwardly extending flange upon which the base of the dispenser is mounted. The dispenser frame can be formed as an integral part of the containment box, or it can be a separate unit that is permanently attached to the containment box such as by rivets. A typical prior art containment box has an integral flange extending around the top of its perimeter. This flange is generally mounted flush with the concrete that forms a conventional service station island. A length of reinforcing angle stock is often attached to the containment box a few inches below the flange to help anchor the containment box in the concrete.

Containment box assemblies are often outfitted with electrical components and electrical wiring extending through conduits for providing electricity to the product dispenser. Electrical penetrations fittings that are not completely sealed, particularly when installed on a double wall product, create a potential leak point and exposure risk. Conventional electrical fittings are often made of an elastomeric rubber and are dependent on contractors in the field for proper installation which may lead to the fittings being installed improperly as opposed to having a factory-installed and tested solution integrated into the product. Elastomeric fittings under stress and chemical exposure common to containment box assemblies typically fail in one to five years after installation due to, among other things, the rubber drying out and becoming brittle or due to improper installation.

Often, holes are drilled through a dispenser frame to install electrical conduits from below ground to the concrete surface where the dispenser sits. Also, sometimes a fiberglass pocket is formed allowing the electrical conduits to pass vertically from below ground through the dispenser frame. These approaches to conduit installation provide limited points of entry into the dispenser. Further, the container box assembly designs may be deficient if the locations prevent the electrician from adjusting the conduit location to avoid the internal hydraulic hardware of the dispenser. If a contractor is required to cut through the structural panel of a dispenser, the warranty of the dispenser may be voided.

SUMMARY OF THE INVENTION

Aspects of the present invention provide a containment box assembly with an anchor frame for anchoring a containment box to either a concrete island, or the concrete driveway of a gasoline service station.

One embodiment includes frame assembly for anchoring a containment box with a top opening in a surrounding driveway surface and for removably attaching one of a plurality of different product dispensers to the containment box. The frame assembly includes an anchor frame attached to the top opening of the containment box, the anchor frame including a plurality of outwardly extending anchoring clamps for anchoring the containment box in the surrounding driveway surface, wherein the anchor frame is configured to be removably attached to any one of a plurality of different dispenser frames and a dispenser frame removably attached to the anchor frame, the dispenser frame including a plurality of frame walls having a frame area larger than an area of the top opening of the containment box such that the frame walls define an offset opening adjacent to the top opening of the containment box, wherein one of the plurality of different product dispensers is adapted to be mounted to the dispenser frame.

The frame assembly may further include a conduit extending along an exterior of the containment box and extending through the offset opening and a railing mount attached to the containment box and a clamp attached to the railing mount, wherein the conduit extends between the clamp and the railing mount. Further, the offset opening may be defined in part by an interior wall extending between two of the frame walls of the dispenser frame and the offset opening may have a width of from about 2 inches to about 6 inches. In one embodiment, the anchor frame is integral to the containment box.

Another embodiment includes a containment box and frame assembly for attachment to one of a plurality of product dispensers having a box assembly for containing fluid spilled from the product dispenser. The box assembly includes a containment box having side walls defining a top opening and a ledge protruding from the side walls and an intermediate box configured to mate with the containment box, the intermediate box including side walls defining a top opening having an area less than an area of the top opening of the containment box and a flange extending from the side walls, the flange configured to engage the ledge of the containment box. A dispenser frame is removably attached to the intermediate box, the dispenser frame including a plurality of frame walls having a frame area larger than an area of the top opening of the containment box such that the frame walls define an offset opening adjacent to the top opening of the containment box, wherein one of the plurality of different product dispensers is adapted to be mounted to the dispenser frame.

DETAILED DESCRIPTION

Figure 1:
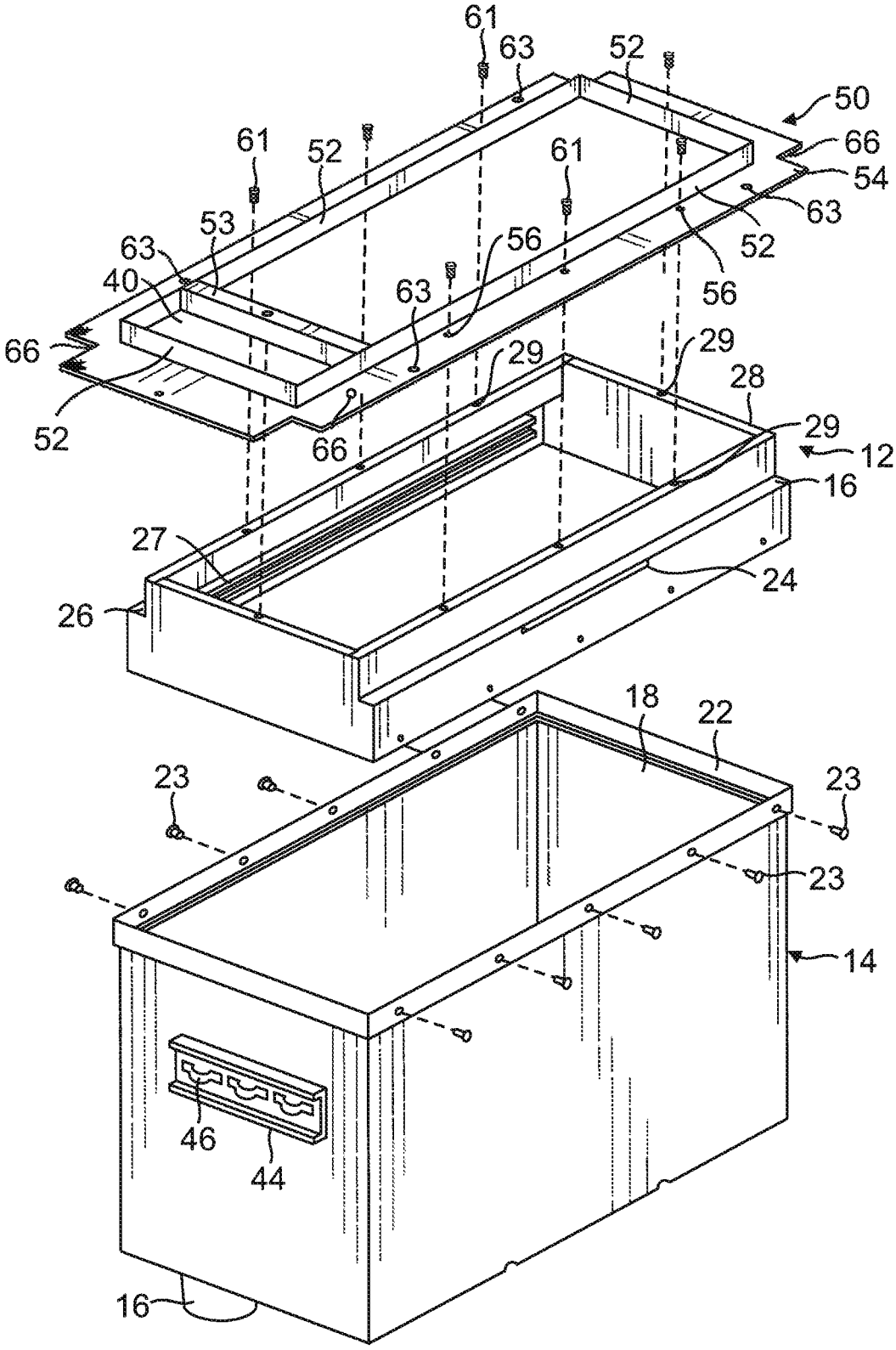
FIG. 1 is an exploded perspective view of an embodiment of a containment box assembly including a containment box, an anchor frame and a dispenser frame of the present invention.

Referring to FIGS. 1-5, a first embodiment of the invention is illustrated including an anchor frame 12 for mounting on a containment box 14. The containment box 14 is of a typical design used beneath a gasoline or other fuel dispenser in a driveway 15 at a service station. When in place, the containment box 14 houses the pipe connections that connect the dispenser to a product pipeline for receiving product from an underground storage tank. The containment box 14 is intended to contain any leakage of product from the dispenser if there is a malfunction of the equipment and piping located in the dispenser. The particular containment box illustrated is designed for use with a three-product fuel dispenser, and therefore, includes three sumps or cups 16 for collecting any leaking product and amplifying the effect of the accumulating product as set forth in U.S. Pat. No. 4,842,163 the entire content of which is incorporated herein by reference. The walls that make up the containment box 14 define a top opening 18 through which the product lines extend to the dispenser.

The anchor frame 12 includes four walls in a rectangular configuration sized to fit in a flared top opening 22 of the containment box such as the one described in U.S. Pat. No. 5,800,143, the entire content of which is incorporated herein by reference. In one embodiment, the anchor frame 12 is riveted to the containment box 14 such as with pop rivets 23. Once riveted in place, caulking is placed in the seam between the containment box 14 and anchor frame 12 to provide a fluid-tight seal. While rivets may be used to attach the anchor frame to the containment box, other fasteners such as nuts and bolts, or sheet metal screws can also be used. Instead of rivets or other mechanical fasteners, the anchor frame 12 can also be bonded with adhesive or welded to the containment box. In yet another embodiment, the anchor frame is provided as an integral part of the containment box. However, the use of fasteners such as rivets permit the use of different materials for the anchor frame and the containment box. For example, the containment box can be made of fiberglass or some other lightweight composite material while the anchor frame can be made of steel.

In order to provide added strength to the containment box and to help anchor the containment box in the concrete driveway, a plurality of anchoring clamps are provided. In this embodiment, a plurality of anchor blades 24 made from angle stock are attached to some or all of the four walls of the anchor frame 12 as the anchoring clamps. One wall of the angle stock is attached to the wall of the anchor frame such as by welding. The other wall of the angle is oriented to extend outwardly from the anchor frame 12 in a plane parallel to the surface of the driveway to form the anchor blade. In addition, the front and back walls of the anchor frame 12 each include an inward step 26 wherein the opening of the anchor frame narrows. This provides additional strength to the anchor frame and permits the use of a large containment box while allowing the same anchor frame to be used with a number of different product dispensers as will be discussed in more detail below. The containment box should be large enough to permit access to the piping within the containment box in the event repairs are necessary.

The anchor frame 12 also includes a pair of rails 27 (one shown) inside the anchor frame 12 on its front and back walls. In one embodiment, the rails 27 are made of channel stock with a C-shaped cross section welded to the walls of the anchor frame. The use of such rails is known in the art. Mounting rails are useful for fastening mounting bars that extend across the containment box between the rails. The mounting bars are useful for supporting the piping within the containment box. The use of rails permits the mounting bars to be moved from side to side to accommodate the specific piping configuration for a particular dispenser. The use of a flexible pipeline in combination with the containment box and frame assembly of the present invention further simplifies modification of the piping configuration as may later be necessary to permit use of a different dispenser and dispenser frame than was originally used.

A typical inner opening size for such an anchor frame is about 40 inches by 14 inches which corresponds to a containment box of similar dimensions. Of course, other sizes may be desired such as for a containment box used with a four-product dispenser (such as is provided for dispensing three grades of gasoline and diesel fuel), or one for a two product dispenser (for dispensing two grades of gasoline). The perimeter of the top opening of the anchor frame 12 also includes an inwardly facing lip 28 with a plurality of holes 29.

Figure 3:
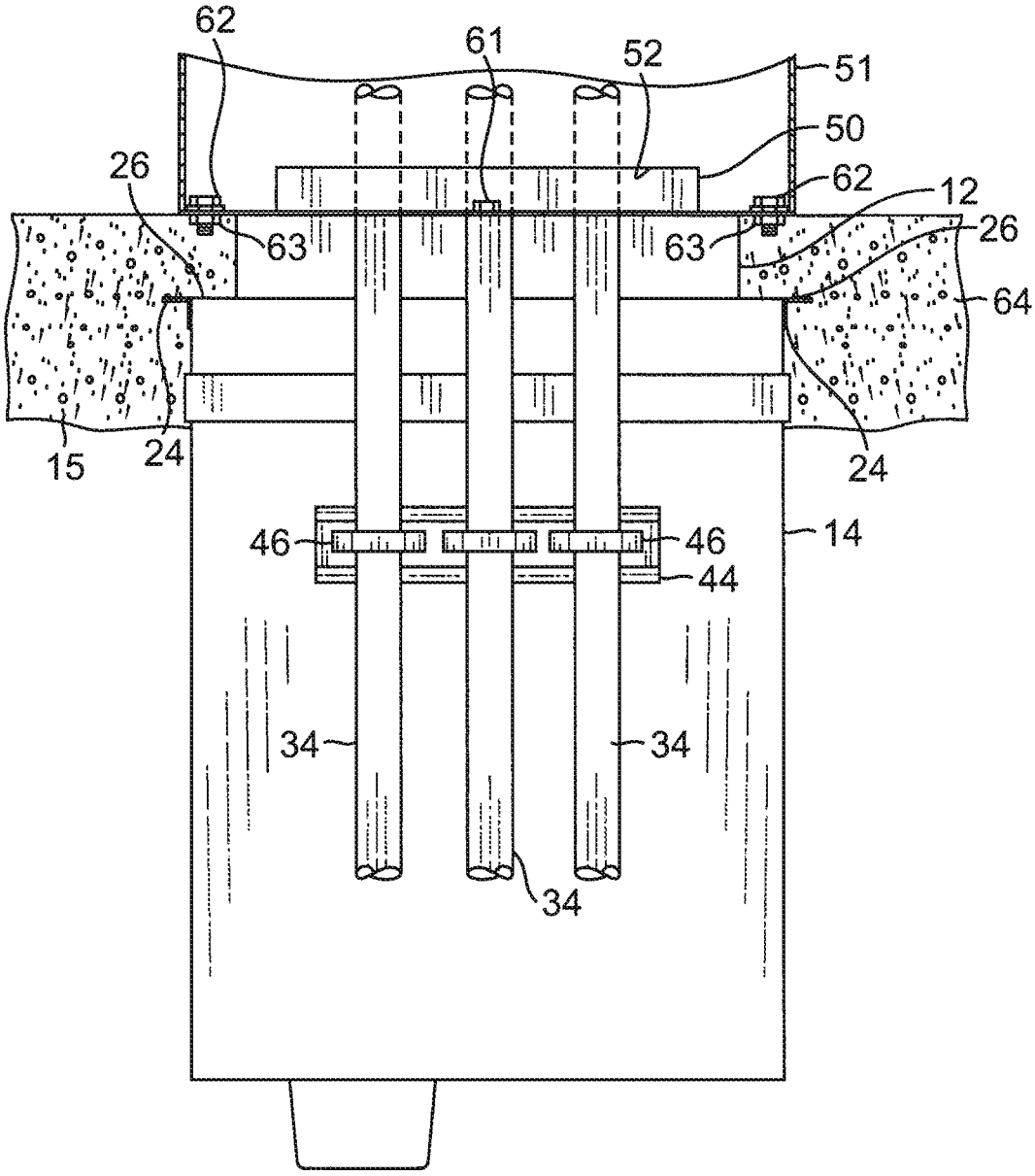
FIG. 3 is a partially cut away side view of the containment box assembly of FIG. 1 after the anchor frame has been set in concrete.
Figure 4:
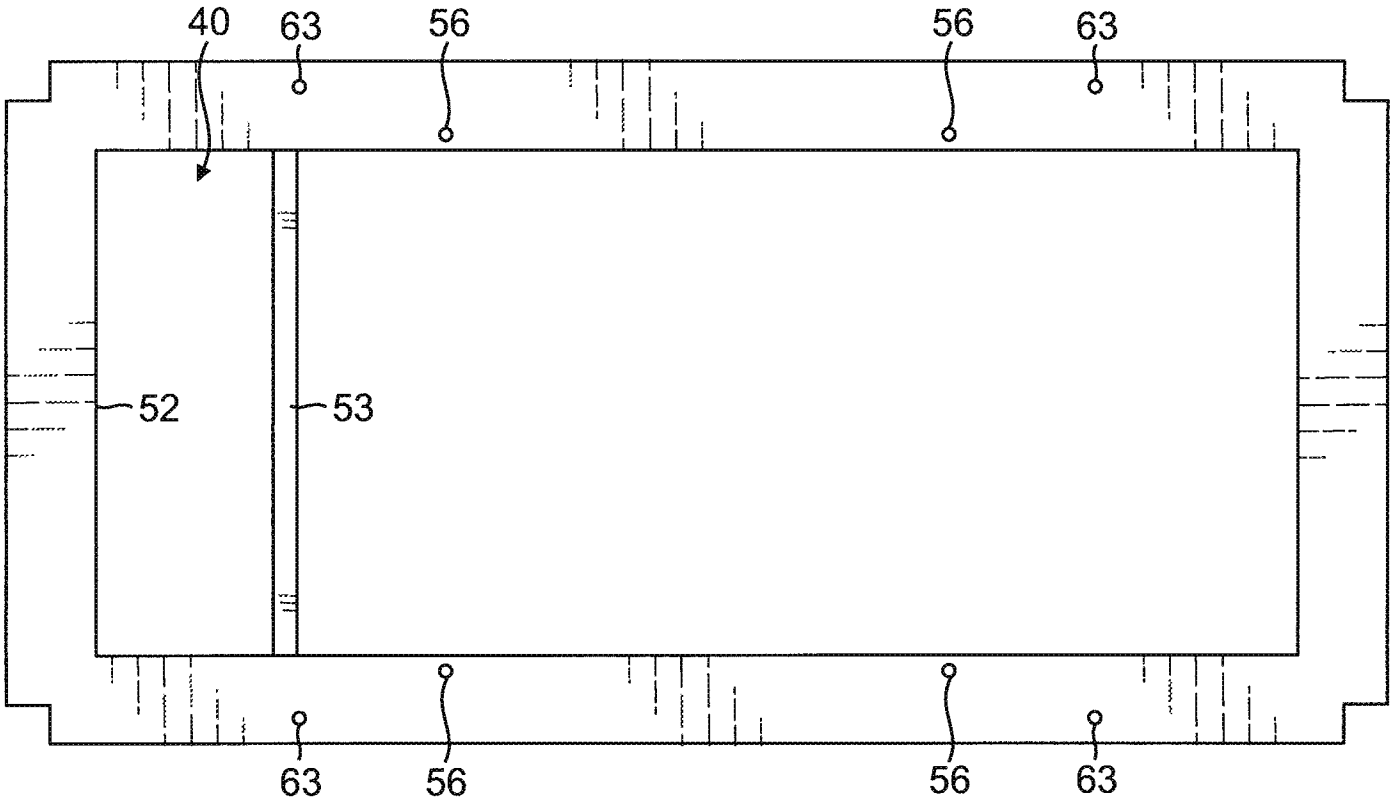
FIG. 4. is a top view of the dispenser frame of FIG. 1.

With reference to FIG. 3, a dispenser frame 50 is mounted to the anchor frame 12 to permit a product dispenser 51 to be bolted to the containment box. The dispenser frame 50 includes four vertical frame walls 52 arranged in a rectangular shape. A lower flange 54 extends outwardly from the base of each of the frame walls 52 in a horizontal plane at the perimeter of the rectangle defined by the frame walls. A plurality of holes 56 in the flange coincide with the holes 29 of the anchor frame. A plurality of bolts 61 and nuts are provided to fasten the dispenser frame 50 to the anchor frame 12. The dispenser frame 50 also includes fasteners for attaching the product dispenser to the dispenser frame 50. In one embodiment, bolts 62 are used to fasten the dispenser to the dispenser frame 50 at a plurality of threaded apertures 63 which may be nuts welded to the underside of the lower flange 54 of the dispenser frame. Generally, four dispenser bolts are used to fasten the dispenser to the dispenser frame.

Figure 2:
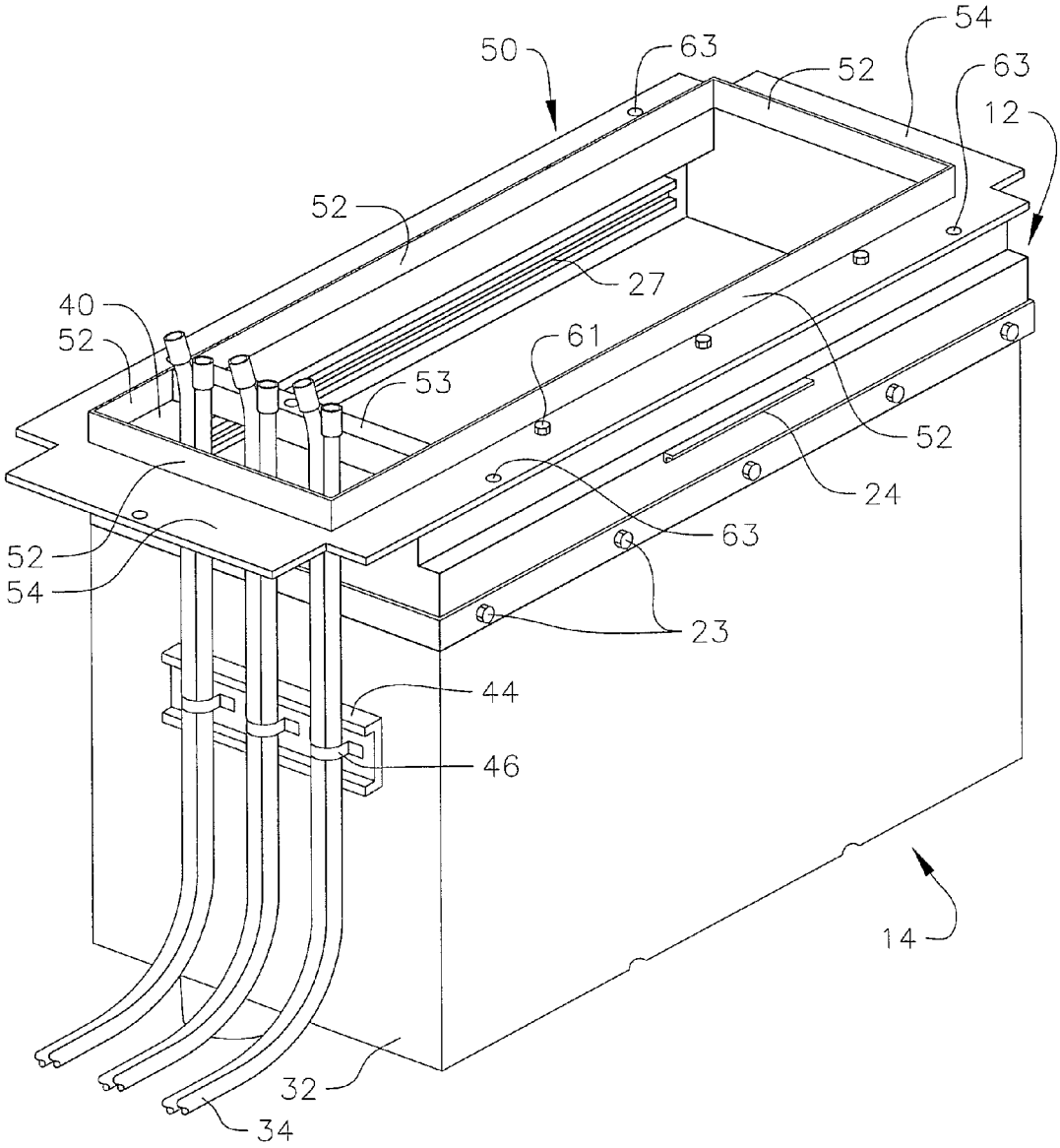
FIG. 2 is a perspective view of the containment box assembly of FIG. 1 with electrical conduits extending through an electrical offset area of the dispenser frame.

The dispenser frame 50 is dimensioned to define a frame area larger than the top opening 18 of the containment box 14 such that a portion of the dispenser frame protrudes past a side wall 32 of the containment box and past the anchor frame 12 to create an electrical offset area 40. In other words, the electrical offset area 40 is generally adjacent to the top opening 18 of the containment box. The electrical offset area 40 extends in plane generally perpendicular to the side wall 32 of the containment box 14 such that electrical conduits 34 extending along an exterior of the containment box 14 are enclosed by the dispenser frame 50. The electrical offset area 40 is defined by a portion of three frame walls 52 and by an interior wall 53 that extends between two opposing frame walls. As shown in FIG. 2, the interior wall 53 may be generally aligned with the side wall 32 of the containment box and the interior wall may be attached to a lip or top edge of the side wall by a fastener. It will be understood, however, that the interior wall 53 may be omitted from the dispenser frame 50. By configuring the dispenser frame 50 to extend past the side wall 32 to provide an electrical offset area 40, the dispenser frame 50 can encompass the electrical conduits 34 extending through the electrical offset area and can protect the portion of the conduits within the product dispenser from impact. Further, holes do not have to be drilled into the side walls of the containment box 14 for the conduits, thereby preventing leakage, potential voiding of warranty and other detriments that accompany drilling such holes. In one embodiment, the dispenser frame 50 extends from about 2 to about 6 inches past the end wall of the anchor frame. In other words, for an anchor frame having an inner opening size of about 40 inches by 14 inches, the dispenser frame 50 has an opening of between about 42 inches to about 48 inches by 14 inches, thereby providing the electrical offset area with between about a 2 inch to 6 inch width. In yet another embodiment, a centerline of the anchor frame 12 is offset from a centerline of the dispenser frame 50 by about 5 inches. It will be appreciated that the dispenser frame 50 can be dimensioned to encompass any conduits extending between the dispenser frame and the containment box 14.

In one embodiment as shown in FIGS. 1 and 3, a mounting rail 44 extends along the end wall of the containment box 14. The mounting rail 44 is made of channel stock with a C-shaped cross-section attached to the side wall 32 to provide a mounting structure to which clamps 46 adapted to receive a conduit are attached. The clamps 46 secure the electrical conduits 34 against the mounting rail 44 and guide the conduits through the dispenser frame's electrical offset area 40. The clamps 46 are attached to the mounting railing 44 by nuts and bolts, or by any other appropriate fastener, such as rivets, screws, or an adhesive.

While only one particular dispenser frame is shown for the containment box 14, it is clear that various different sizes of dispenser frames can be provided, each of which will fit on a common anchor frame and provide an electrical offset area as described above. By producing a number of different sizes of dispenser frames that can be connected to a single size of containment box and anchor frame, a containment box manufacturer can maintain a smaller inventory of dispenser boxes than was previously possible. While several different sizes of dispenser frames may need to be kept in the manufacturer's inventory, since the dispenser frames are of a fairly simple construction and are of a fairly compact size compared to a conventional containment box with an integral dispenser frame, it is far less expensive to manufacture and store a large number of dispenser frames than a comparable number of containment boxes with integral dispenser frames.

In one embodiment, the various components that make up the anchor frame 12 are fabricated from a strong and durable material such as 12 gauge steel. For the anchor frame, this permits the various components that make up the anchor frame to be welded together. As pointed out above, the containment box can be fabricated from a number of different materials including steel, fiberglass, steel lined with fiberglass, or composites. Such materials are well known in the art. In one embodiment, the dispenser frame 50 is made of steel, but could be made of other materials as well.

Figure 5:
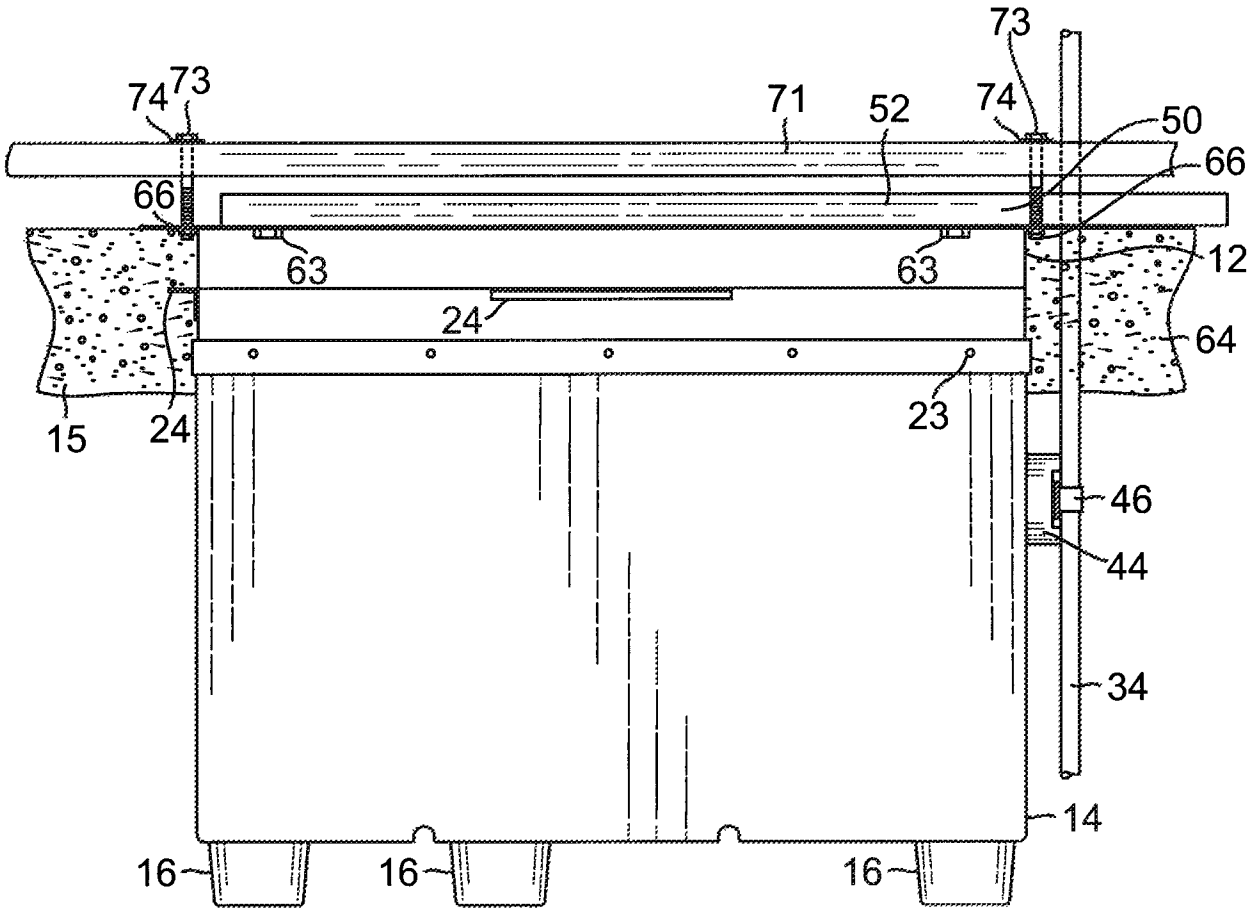
FIG. 5 is a partially cut away front view of the assembly of FIG. 1 during installation in a concrete driveway.

According to FIGS. 3 and 5, the dispenser frame 50, anchor frame 12 and containment box 14, once attached to one another, are set in the concrete 64, or some other surfacing material, so that the top of the anchor frame is level with the top of the concrete and the dispenser frame rests on the concrete. The anchor blades 24 of the anchor frame 12 help to hold the assembly firmly in the concrete. The electrical conduits extend along an exterior of the containment box 14 and the dispenser frame 12 and may be secured to the containment box by the clamps 46 at the mounting rail 44. The electrical conduits 34 extending through the electrical offset are of the dispenser frame 50 and into the product dispenser 51.

During installation of the containment box 14 and anchor frame 12, the four dispenser bolts 62 should be threaded into the threaded apertures 63 so that a small void under each nut on the dispenser frame is created in the concrete. After the concrete has set, the bolts can be removed and used to attach the product dispenser 51 to the dispenser frame 50. In order to simplify the removal of the bolts from the concrete, the thread of each bolt should be coated with grease while the concrete is setting.

In order to simplify the leveling of the anchor frame 12 during its installation in the concrete of the service station, in one embodiment, the dispenser frame 50 is provided with four leveling nuts 66 at the four corners of the dispenser frame. The use of the leveling nuts 66 is illustrated in FIG. 5. A pair of temporary support arms 71 (one shown), such as two lengths of wooden two by four, are held suspended over the location where the anchor frame 12 and containment box 14 are to be installed. The temporary support arms can be suspended by the use of pieces of scrap wood, concrete blocks or various other methods to hold them a distance above the ground. Four leveling bolts 73, each with a washer 74, extend through holes in the temporary support arms and are threaded into the nuts. By tightening a particular bolt, a corner of the dispenser frame can be raised. By loosening that bolt, the corner of the dispenser frame can be lowered. The assembly is leveled by tightening or loosening the four leveling bolts as necessary. Once the assembly has been leveled, the concrete can be poured. Of course, minor adjustments can also be made in the level of the containment box immediately after the concrete has been poured but before it sets. After the concrete has partially set, the anchor frame 12 will tend to stay in its level position while the concrete is fully curing. Therefore, the support arms 71 and bolts 73 can be removed before the concrete has fully set.

Figure 6:
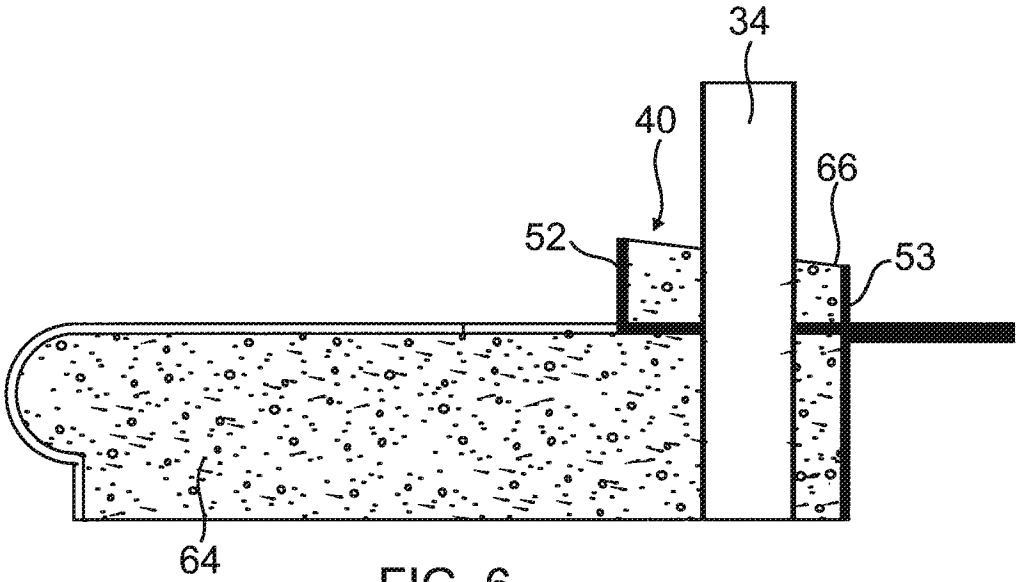
FIG. 6 is a sectional view of an embodiment of a concrete island with the containment box assembly of FIG. 1 installed in the concrete island.

In one embodiment with reference to FIG. 6, when the containment assembly has been installed within the concrete 64 such that the electrical conduit 34 extends within the electrical offset area 40 of the dispenser frame 50, a top surface 66 of the concrete between the frame walls 52 and the interior wall 53 may be sloped downward from a top of the frame wall 52 to a top of the interior wall 53 such that liquid on the concrete surface will drain toward the interior of the dispenser frame 50 and into the containment box 14. The areas where a concrete surface meets the conduit 34 and the interior wall 53 can be sealed by a sealant to prevent liquid from penetrating between the concrete and the containment assembly.

In order to protect against corrosion, any steel components of the containment box, anchor frame and dispenser frame should be painted, preferably by a powder coating process. Such processes and the materials they use are well known in the art as similar coatings are typically provided on steel containment boxes.

While the anchor frame 12 and dispenser box 14 are illustrated as separate components, it is clear that the two could be formed as an integral unit. Since a single design for the containment box can be used with a number of different dispenser frames to accommodate various different dispenser designs, the containment box manufacturer can maintain a reduced inventory of containment boxes, yet still satisfy its customers' demands.

According to an embodiment of the present invention, once a containment box assembly including an anchor frame and dispenser frame has been installed, the replacement of the dispenser frame to accommodate a different style or brand of product dispenser can be easily performed. The existing dispenser is removed along with the dispenser frame. A new dispenser frame including an electrical offset area is selected to accommodate the new dispenser and accompanying electrical conduits and the new dispenser frame is bolted to the existing anchor frame. If necessary, holes can be drilled in the concrete before the dispenser frame is bolted in place to accommodate the dispenser mounting bolts for the new dispenser. Any changes in the piping configuration within the box can also be made easily, especially if flexible piping is used. The rails on the front and back of the anchor frame permit adjustment of the orientation of the mounting bars and the various pipelines to accommodate differences between dispenser designs.

Figure 7:
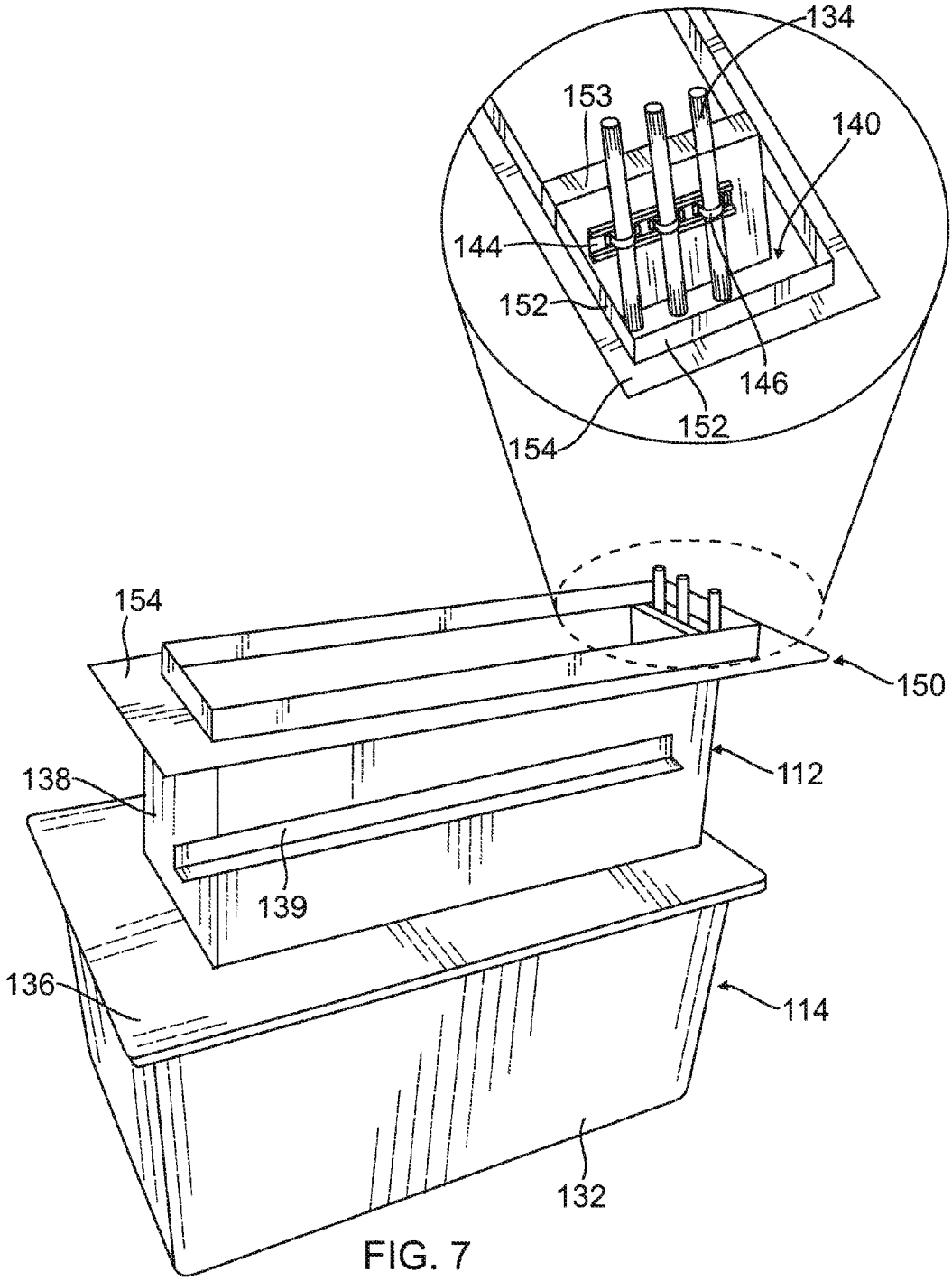
FIG. 7 is a schematic perspective view of another embodiment of a containment box assembly of the present invention.
Figure 8:
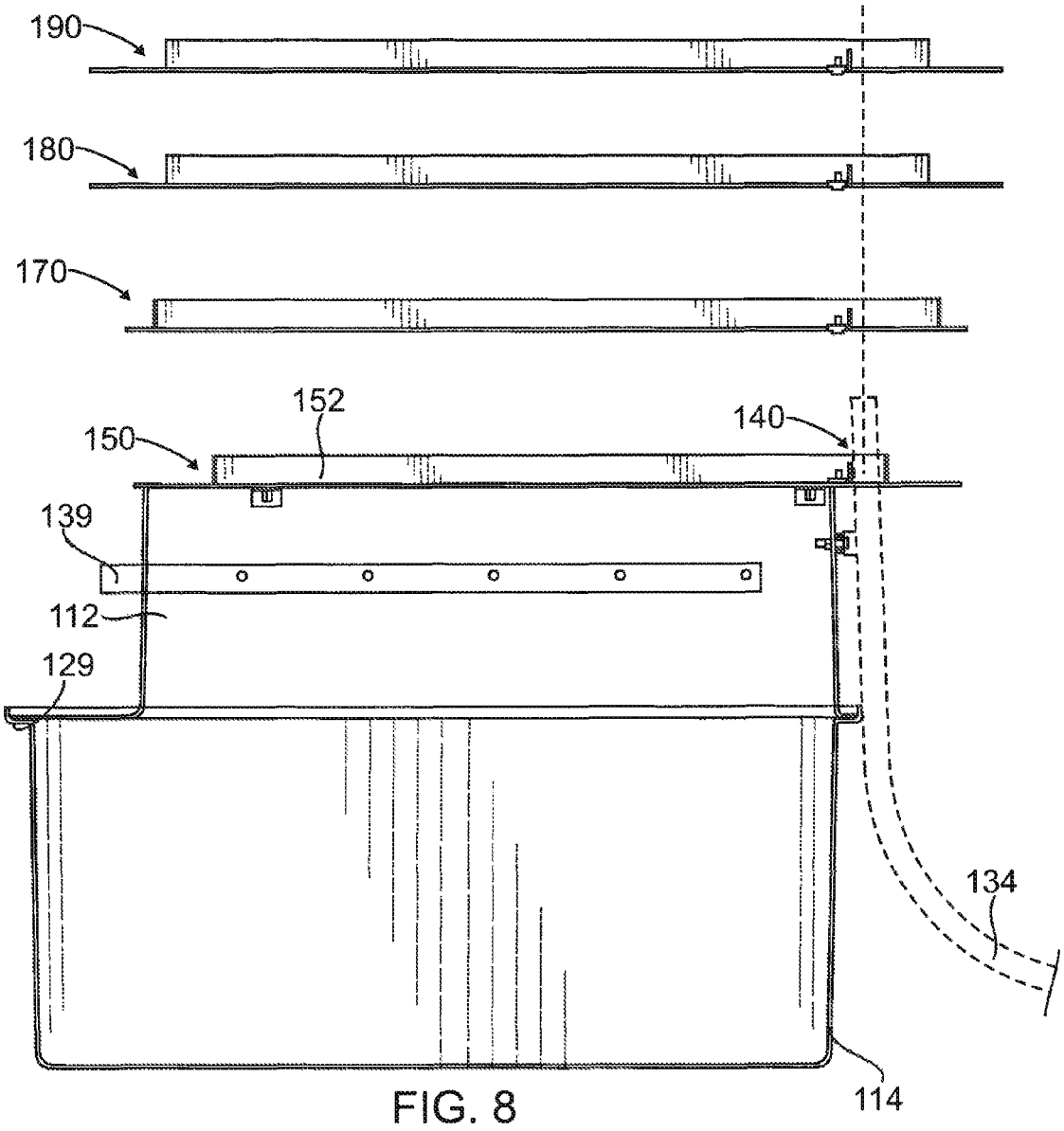
FIG. 8 is a side view of embodiments of dispenser frames of the present invention adapted to be mounted onto a containment box.

In another embodiment, a split level containment assembly is provided as shown in FIGS. 7 and 8. The split level containment assembly includes a containment box 114 similar to the containment box of previously described embodiments and an intermediate box 112 configured to mate with the containment box 114. In one embodiment, the containment box 114 has an inwardly facing ledge 129 that extends around a perimeter of the top of side walls 132 of the containment box on which the intermediate box 112 rests when the boxes are combined as described in more detail below.

The intermediate box 112 includes four side walls 138 in a rectangular configuration having an area smaller than an area of an open top of the containment box 114 and a flange 136 extending outwardly from a bottom of the side walls, the flange having an area about equal to an area of the top opening of the containment box 114. In one embodiment, the flange 136 does not extend an equal length around the side walls 138, but rather is configured such that a portion of the flange extending adjacent to one of the side walls, for example, a short or lateral side wall, extends a shorter distance than the rest of the flange. As such, the side walls 138 defining a box portion are offset with respect to the flange 136 and one of the side walls 138 of the intermediate box 112 can be generally aligned with a side wall 132 of the containment box 114 when the intermediate box is attached to the containment box.

During shipping of the split level containment assembly of the present embodiment, the intermediate box 112 can be inverted and stored within the containment box 114 such that the side walls 138 are within the containment box and the flange 136 rests on the ledge 129 of the containment box. Additionally, other components, such as the dispenser frame 150 can also be stored in the containment box during shipping. As such, the split level containment assembly can have a substantially smaller profile for shipping than in its assembled state. When the split level containment assembly is installed, the components can be removed from the containment box 114 and the intermediate box 112 can be rotated such that the flange 136 rests on the ledge 129, but the side walls 138 protrude outwardly with respect to the containment box as shown in FIG. 7. To provide further support and a stronger attachment between the intermediate box 112 and the containment box 114, fasteners such may be inserted into holes on the flange 136 and the ledge 129.

A railing 139 is attached to each of the two long or longitudinal side walls 138, the railing generally having a L-shaped configuration with one leg flush with and attached to the side wall and the other leg extending outwardly from the sidewall. The railing 139 may be attached to the side wall 138 by bolts or any other appropriate fastener. The railing 139 provides additional support to interior mounting rails on the intermediate box 112 for fastening mounting bases as described above with respect to the containment box 14.

A dispenser frame 150 similar to the dispenser frame described with respect to previous embodiments is mounted to the intermediate box 112. The dispenser frame includes four upper frame walls 152 arranged in a rectangular shape. A lower flange 154 extends outwardly from the base of each of the upper frame walls 152 in a horizontal plane at the perimeter of the rectangle defined by the frame walls. In one embodiment, lower frame walls extend from the lower flange 154 in a direction substantially opposite to the upper frame walls 152. The lower frame walls are adapted to engage the side walls 138 of the intermediate box 112 to attach the dispenser frame 150 to the intermediate box. A sealant can be applied to the lower frame walls to more permanently attach the dispenser frame to the intermediate box 112. Alternatively, bolts can be inserted through holes in the lower flange 154 and in an upper lip of the intermediate box 112 and secured with nuts to fasten the dispenser frame 150 to the intermediate box 112. In another embodiment, the intermediate box 112 and the containment box 114 may be a single integral piece.

The dispenser frame 150 is dimensioned such that a portion of the dispenser frame protrudes past a side wall 132 of the containment box 114 to create an electrical offset area 140 through which electrical conduits 134 can extend similar to the electrical offset area described above. The electrical offset area 140 is defined by a portion of three frame walls 152 and by an interior wall 153 that extends between two frame walls. As shown in the inset of FIG. 7, the interior wall 153 may be aligned with the side wall 132 of the containment box. By configuring the dispenser frame 50 such that it extends past the side wall 132, the dispenser frame 150 can encompass electrical conduits 134 extending on an exterior of the containment box 114 and can protect the portion of the conduits within the product dispenser from impact. Further, holes do not have to be drilled into the side walls of the containment box for the conduits, thereby preventing leakage, potential voiding of warranty and other detriments that accompany drilling such holes. In one embodiment, the dispenser frame 150 extends from about 5 inches past the end wall of the anchor frame, but it will be appreciated that the dispenser frame can extend any distance to allow conduits to extend between the dispenser frame and the containment box.

As shown in the inset to FIG. 7, a mounting rail 144 extends along a side wall 132 of the containment box 114. The mounting rail 144 is made of channel stock with a C-shaped cross-section attached to the end wall to provide a mounting structure to which clamps 146 are attached. The clamps secure the electrical conduits 134 against the end wall 132 and accurately guide the conduits through the dispenser frame's electrical offset area 140.

With reference now to FIG. 8, the dispenser frame 150 is shown attached to the intermediate box 112 with an electrical conduit 134 extending through the electrical offset area 140. Also shown in FIG. 8 are various differently sized dispenser frames 170, 180, 190 all adapted to mate with the intermediate box 112 and provide an electrical offset area for the conduit 134. As will be appreciated, differently sized dispenser frames with differently dimensioned electrical offset areas can be attached to the same containment box assembly, thereby allowing a containment box manufacturer to maintain a smaller inventory of containment boxes than was previously possible.

Although embodiments of the present invention have been described in detail above, it should be understood that many variations and modifications of the basic inventive concept herein described will still fall within the spirit and scope of the present invention as defined in the appended claims.

What is claimed is:

1. A frame assembly for anchoring a containment box with a top opening in a surrounding driveway surface and for removably attaching one of a plurality of different product dispensers to the containment box, the one of a plurality of product dispensers adapted to receive a plurality of conduits, the frame assembly comprising:

an anchor frame configured to be attached to the top opening of the containment box, the anchor frame defining a top opening; and a dispenser frame configured to be removably attached to the anchor frame and to which the one of the plurality of product dispensers is adapted to be removably mounted, the dispenser frame including a plurality of frame walls defining a frame area larger than an area of the top opening of the anchor frame such that the frame walls define an offset opening adjacent to the top opening of the anchor frame, wherein at least one of the plurality of conduits may extend through the offset opening.

2. A frame assembly for anchoring a containment box with a top opening in a surrounding driveway surface and for removably attaching one of a plurality of different product dispensers to the containment box, the frame assembly comprising:

an anchor frame attached to the top opening of the containment box, the anchor frame including a plurality of outwardly extending anchoring clamps for anchoring the containment box in the surrounding driveway surface, wherein the anchor frame is configured to be removably attached to any one of a plurality of different dispenser frames;

a dispenser frame removably attached to the anchor frame and to which the one of the plurality of product dispensers is adapted to be removably mounted, the dispenser frame including a plurality of frame walls defining a frame area larger than an area of the top opening of the containment box such that the frame walls define an offset opening adjacent to the top opening of the containment box; and a conduit extending along an exterior of the containment box and extending through the offset opening.

3. The frame assembly of claim 2 further comprising a railing mount attached to the containment box and a clamp attached to the railing mount, wherein the conduit extends between the clamp and the railing mount.

4. The frame assembly of claim 1, wherein the offset opening is defined in part by an interior wall extending between two of the frame walls of the dispenser frame.

5. The frame assembly of claim 1, wherein the offset opening has a width of from about 2 inches to about 6 inches.

6. The frame assembly of claim 1, wherein the anchor frame is integral to the containment box.

7. A frame assembly for anchoring a containment box with a top opening in a surrounding driveway surface and for removably attaching one of a plurality of different product dispensers to the containment box, the one of a plurality of product dispensers adapted to receive a plurality of conduits, the frame assembly comprising:

an anchor frame configured to be attached to the top opening of the containment box, the anchor frame defining a top opening; and a dispenser frame adapted to be removably attached to the anchor frame and to which the one of the plurality of product dispensers is adapted to be removably mounted, the dispenser frame including a plurality of frame walls dimensioned to define a frame opening such that when the dispenser frame is attached to the anchor frame a first portion of the frame opening coincides with the top opening of the anchor frame and a second portion of the frame is offset from the top opening of the anchor frame and defines an offset area, wherein at least one of the plurality of conduits may extend through the offset area of the dispenser frame.

8. A frame assembly for anchoring a containment box with a top opening in a surrounding driveway surface and for removably attaching one of a plurality of different product dispensers to the containment box, the frame assembly comprising:

an anchor frame attached to the top opening of the containment box, the anchor frame including a plurality of outwardly extending anchoring clamps for anchoring the containment box in the surrounding driveway surface, wherein the anchor frame is configured to be removably attached to any one of a plurality of different dispenser frames;

a dispenser frame adapted to be removably attached to the anchor frame and to which the one of the plurality of product dispensers is adapted to be removably mounted, the dispenser frame including a plurality of frame walls dimensioned to define a frame opening such that when the dispenser frame is on the anchor frame a portion of the frame opening is aligned with the top opening of the containment box and a portion of the frame opening is offset from the top opening of the containment box; and a conduit extending along an exterior of the containment box and extending through the portion of the frame offset from the top opening.

9. The frame assembly of claim 8 further comprising a railing mount attached to the containment box and a clamp attached to the railing mount, wherein the conduit extends between the clamp and the railing mount.

10. The frame assembly of claim 7 further comprising an interior wall extending between two of the frame walls of the dispenser frame.

11. The frame assembly of claim 7, wherein the offset area of the dispenser frame has a width of between from 2 inches to about 6 inches.

12. The frame assembly of claim 7, wherein the anchor frame is integral to the containment box.

13. The frame assembly of claim 1, wherein the anchor frame further comprises a plurality of outwardly extending anchoring clamps for anchoring the containment box in the surrounding driveway surface.

14. The frame assembly of claim 7, wherein the anchor frame further comprises a plurality of outwardly extending anchoring clamps for anchoring the containment box in the surrounding driveway surface.

* * * * *